United States Patent [19]

Grosskopf

[11] 4,422,305

[45] Dec. 27, 1983

[54] COLD STORAGE ELEMENT, MOUNTING ASSEMBLY AND AIR CONTROL SLATS THEREFOR

[76] Inventor: Peter V. Grosskopf, Am Ruhrstein 25, 4300 Essen 1, Fed. Rep. of Germany

[21] Appl. No.: 364,355

[22] Filed: Apr. 1, 1982

[51] Int. Cl.[3] ..... F25D 11/00

[52] U.S. Cl. ..... 62/430; 62/275

[58] Field of Search ..... 62/430, 434, 437, 275, 62/277, 285

[56] References Cited

U.S. PATENT DOCUMENTS 2,241,411 5/1941 McGuffey ..... 62/430
2,486,822 11/1949 Cameron ..... 62/437
2,624,554 1/1953 Morrison ..... 62/437
2,764,876 10/1956 Pacaro ..... 62/434

*Primary Examiner*—Ronald C. Capossela
*Attorney, Agent, or Firm*—Felfe & Lynch

[57] ABSTRACT

A cold storage element containing an eutectic brine cooled to a given freezing point for the cold storage purpose by one or more refrigerant-conducting pipelines for freezing the brine, and said element being arranged interiorly of the body (structure) of a refrigerating vehicle. The cold storage element comprises a plastics material shell which has a rectangular configuration and a longitudinal weg or rib interconnecting the opposing sidewalls. The pipeline for said refrigerant passes in hair-pin configuration through both an upper compartment and a lower compartment defined by said longitudinal rib. Mounting assemblies and air control slats for such cold storage element are also provided.

9 Claims, 5 Drawing Figures

COLD STORAGE ELEMENT, MOUNTING ASSEMBLY AND AIR CONTROL SLATS THEREFOR

The present invention relates to a cold storage element containing an eutectic brine.

It is conventional to use cold storage elements filled with a brine for cold storage in a plate-like form or in the form of circular pipes of metal. However, it is disadvantageous in these conventional configurations and constructions of cold storage elements that the cold releasing or heat absorbing surface, of the elements is limited in surface area and in the case of a single row arrangement amounts to a maximum of the 1.6-fold of the base area of the vehicle structure or body. Further, it is of disadvantage with elements having a plate shape, that such elements must have only a short length in order to withstand the static loads exerted during braking or starting of the vehicle, and that, when metal pipes extending longitudinally through the vehicle body are used, the pipes are filled with a gelling cold storage medium exhibiting inferior refrigerating characteristics.

Accordingly, the effectiveness (efficiency), as measured by cold storing capacity or cold releasing capability, respectively, is greatly limited in the conventional elements.

In view of this, it is the object of the present invention to provide cold storage elements and, further, facilities of mounting such elements, which are free from the above-discussed drawbacks, which may be manufactured economically, and which have particularly an effective heat transfer surface area exceeding that of the conventional elements by multiples thereof.

Furthermore, the cold storage elements according to the invention are contemplated to be filled with normal eutectic brine; these elements are intended to extend across the full length of the vehicle body; still further, it should be possible to perform a thaw off or de-icing operation of the surface even in the loaded state (of the vehicle).

Still further, there should be opened the possibility of for the first time employing cold storage elements for refrigerating purposes without the use of a partition wall or ceiling which would require auxiliary forced air circulation means, even when temperatures above the freezing point exist within the vehicle, and the cold storage elements should thereby be of low height as compared to their storing capacity, such that loading and unloading of the vehicle body is not impeded thereby. In this structure, it should be possible to cool the brine in the conventional manner.

In a cold storage element of the type as outlined at the beginning, this object is achieved in accordance with the invention in that said element comprises a plastics material shell which has a rectangular configuration and includes a longitudinal web or rib interconnecting the opposing sidewalls of said element. Also, the pipeline for said refrigerant passes in hairpin configuration through both an upper compartment and a lower compartment defined by said longitudinal rib.

In order to take up the pressure or loads applied to the walls especially during deceleration and acceleration of the vehicle, transverse ribs are preferably provided for further subdivision within the two compartments, which transverse ribs include at least one aperture of small size for charging the elements with brine, without increased mass transport through this aperture taking place within a short period.

Advantageously, simple non-return flaps may be provided within the apertures to prevent displacement of the brine during a braking operation.

For thaw off or de-icing of the elements and for their operation also in the plus (positive) centigrade temperatue range, preferably a channel is disposed below each rectangular shell for the collection of the thawed-ice water. The opening of such channel is directed upwards, its width exceeds the width of the shell and a pipeline for passing heating liquid therethrough or an electrical heating rod may be provided within each channel for speeding up the de-icing of the elements.

Advantageously, the plastic shell of the elements is transparent to observe the freezing state of the brine. Still further, the surface of the shell may have applied thereto a parting agent, such as silicone oil or the like, which acts to retard ice formation and facilitate separation or release of ice. Alternatively, the plastic surface may include an integrated parting or wax-like surface (PTFE, PE).

Preferably, the vehicle body or structure for the mounting of the cold storage elements includes transverse members for supporting the elements thereon, which members may be arranged with a regular spacing from each other. An adjustable or thermostat-controlled slat may be disposed within or beneath the gap between adjacent elements, which slat extends across the length of the elements and the width of which is approximately equal to the width of the gap. The flap is mounted for movement centrally along its longitudinal axis for compensating the forces exerted thereto.

Below, an embodiment of the invention is described in greater detail by referring to the enclosed drawings, wherein:

FIGS. 1*a* and 1*b* illustrates cold storage elements of conventional construction and arrangement;

Figure 1B:
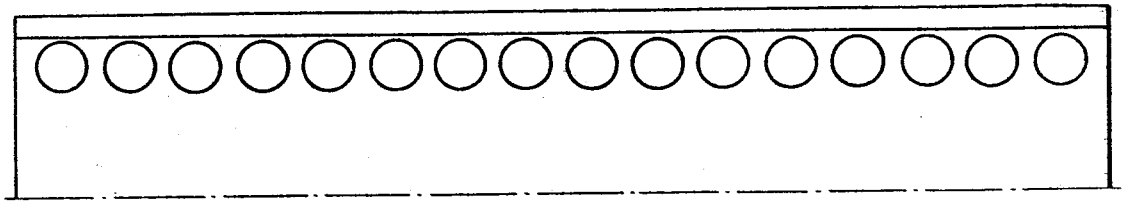
Figure 1A:
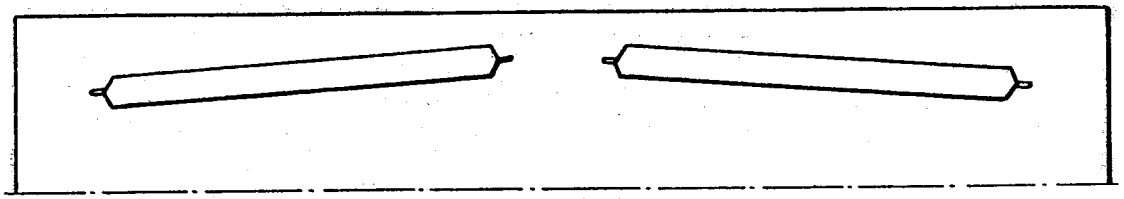
Figure 2:
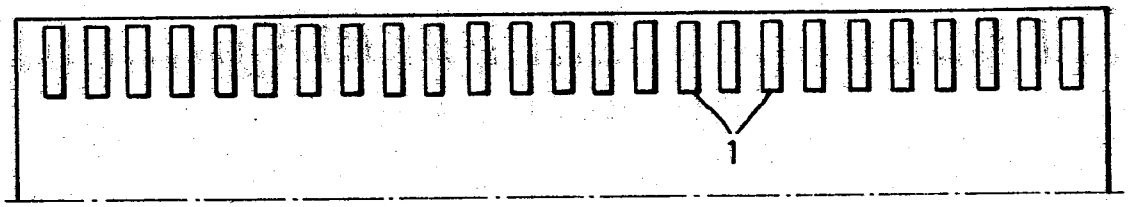
FIG. 2 is a sectional view of adjacently positioned cold storage elements according to the invention.
Figure 3:
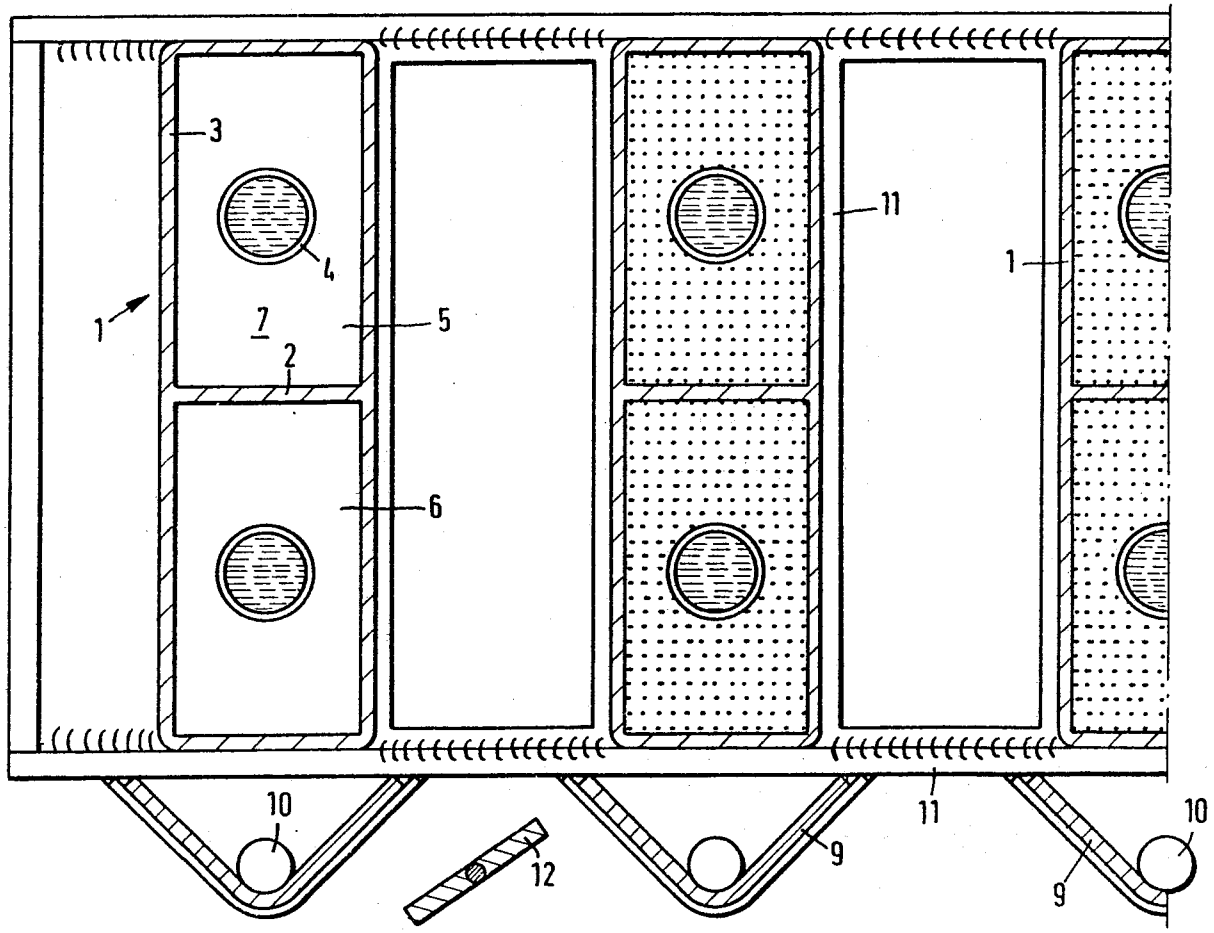
FIG. 3 is a cross-sectional view of the stationarily mounted cold storage elements including a transverse member.
Figure 4:
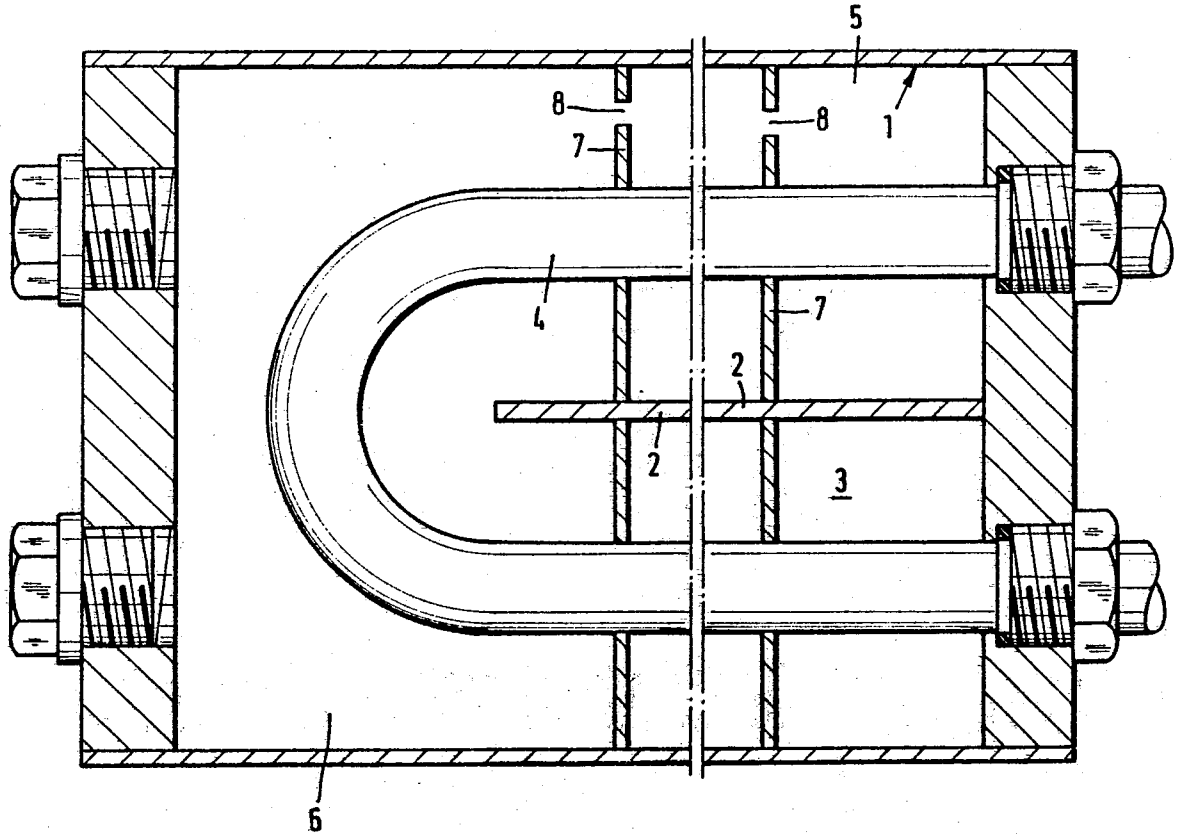
FIG. 4 is a longitudinal sectional view of the cold storage elements according to the invention.

As shown in FIGS. 1*a* and 1*b*, conventional cold storage elements comprise plates (panels) or pipes filled with gelled brine. In contrast, as shown in FIG. 3, the storage element according to the invention comprises a rectangular shell or housing 1 which includes in the central part thereof a longitudinal web or rib 2 spanning the opposite sidewalls 3, so as to define an upper compartment 5 and a lower compartment 6 for the eutectic brine. Interiorly of the compartments 5 and 6, a pipe 4 for the refrigerant extends in hair-pin configuration, with the refrigerant acting to bring the brine to the desired low temperature to thereby cause it to freeze.

Arranged within the shell 1 are mutually spaced transverse ribs or webs 7 which are each provided with at least one small aperture 8.

The elements formed of a plastics material, namely polyethylene, and their surfaces are coated with a parting agent such as, for example, silicone oil. This parting agent either prevents the deposition of ice, or the ice is prevented from tightly adhering to the plastic surface, such that the ice drops down automatically under the vehicle's motions during travel.

As shown in the Figures, alternatively V-shaped channels 9 may be provided below the elements, which channels have heating rods 10 passing therethrough and in which the width of the upwardly directed opening is wider than the width of the cold storage elements. In the thawing off or de-icing process, the draining water is collected by these channels and drained, such that de-icing can be effected even when the vehicle body is loaded (with goods); more particularly, the cold storage elements may be used also in the plus (positive) temperature range since condensed water is similarly drained via the channels 9 so as to be prevented from affecting the goods to be refrigerated.

The cold storage elements are mounted to transverse members 11 stationarily secured within the vehicle body and which may be positioned with a substantial spacing from each other as the cold storage elements have improved self-supporting characteristics owing to their favorable cross-sectional configuration. In the case of shorter and smaller vehicles, it is sufficient for the transverse members to be provided only on the front and rear walls of the vehicle body, whereby optimum utilization of the refrigerated space is rendered possible.

As shown in the Figures, the cold storage elements are mutually spaced by a distance corresponding approximately to their width; disposed in the gap or beneath the gap between two adjacent elements is a slat 12 which is mounted for rotation along its center (longitudinal) axis and which acts to control by its setting the air flow passing between the elements. The slats 12 may be adjusted or operated automatically, by mechanical means through a temperature (thermostat) bellows without any energy supply thereto; alternatively, they may be set also by means of an electric motor under thermostat control.

In a manner being surprising to the one skilled in the art, the cold storage elements according to the invention for the first time permit the use of long rectangular shells or tubes of plastics material while avoiding the necessity for the gelling of the eutectic brine filled into these elements, which would mean a reduction of the cold storage capability. Static loads produced especially during vigorous braking (decelerating) of the vehicle involved are taken up by the longitudinal rib and the transverse ribs 7, whereby the apertures 8 on the one hand permit filling of the elements, while on the other hand displacement of the refrigerant is suppressed to such extent that the employment of rectangular plast shells is rendered possible.

The apertures 8 of the transverse ribs 7 may have positioned therein simple non-return flaps of, for example, plastics material, which prevent displacement of the brine during braking operations, while sufficiently opening the apertures 8 when brine is being filled in. In this embodiment, the non-return flaps are mounted to the transverse ribs on the rear sides thereof as seen in direction of travel, and these flaps are closed under the pressure of the brine when the vehicle is decelerated in braking. When brine is being charged in the opposite (flow) direction, the flaps are capable of opening under the elasticity of the plastics material employed.

I claim:

1. In an element for cold storage in a vehicle, the element having at least one container for an eutectic brine and a refrigerant-conducting pipeline passing therethrough for bringing the eutectic brine to a temperature for the cold storage, the improvement to the element comprising:

a plastic shell (1) of rectangular cross section for forming the container for the brine;

a longitudinal web (2) interconnecting opposite side walls inside the plastic shell (1) for dividing the plastic shell (1) into upper and lower compartments (5,6) in the orientation of the plastic shell (1) in the vehicle in use; and a hair-pin turn in one end of the refrigerant-conducting pipeline (4) in the element for passing the refrigerant-conducting pipeline (4) through both the upper and lower compartments (5,6) of the plastic shell (1).

2. The cold storage element according to claim 1, and further comprising: transverse webs (7) within both compartments (5,6) for further subdivision thereof.

3. The cold storage element according to claim 2, and further comprising: apertures (8) in said transverse ribs (7) for filling said compartments with said brine.

4. The cold storage elements according to claim 3, and further comprising: non-return flaps at the apertures (8) to prevent displacement of the brine during a vehicle braking operation.

5. The cold storage element according to claim 13, 2, 3, or 4, and further comprising: a narrow channel (9) below each rectangular shell (1), an open side of said channel being directed upwards and the width of said channel exceeding the width of said shell (1) for defining a sufficient air circulation area.

6. The cold storage element according to claim 5, and further comprising: heating means in said channel for quicker de-icing of said shell.

7. The cold storage element according to claim 1, wherein said plastic shell is transparent so as to permit observation of the freezing state of the brine contained therein.

8. The cold storage element according to claim 1 and further comprising: a parting agent on the outside surface of said shell (1) for retarding the deposition of ice and promoting the release of ice.

9. The cold storage element according to claim 1, and further comprising a slat (12) extending along the full length of the plastic shell, beneath the plastic shell, and approximately edge aligned therewith; and means for thermostatically rotating the slat about its longitudinal axis.

* * * * *